US010006623B2

(12) United States Patent
Kwon et al.

(10) Patent No.: US 10,006,623 B2
(45) Date of Patent: Jun. 26, 2018

(54) LIGHTING DEVICE

(71) Applicant: Samsung Electronics Co., Ltd, Gyeonggi-do (KR)

(72) Inventors: Young-kwang Kwon, Gyeonggi-do (KR); Hyung-jin Kim, Gyeonggi-do (KR); Do-hyeon Lee, Gyeonggi-do (KR); Bang-won Oh, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 127 days.

(21) Appl. No.: 15/132,173

(22) Filed: Apr. 18, 2016

(65) Prior Publication Data

US 2016/0230979 A1 Aug. 11, 2016

Related U.S. Application Data

(63) Continuation of application No. PCT/KR2014/009376, filed on Oct. 6, 2014.

(30) Foreign Application Priority Data

Oct. 17, 2013 (KR) ..... 10-2013-0123796

(51) Int. Cl.
*F21V 29/00* (2015.01)
*F21V 31/00* (2006.01)
(Continued)

(52) U.S. Cl.
CPC ..... *F21V 31/00* (2013.01); *F21K 9/275* (2016.08); *F21V 15/015* (2013.01); *F21V 23/06* (2013.01);
(Continued)

(58) Field of Classification Search
CPC .... F21K 9/275; F21K 9/27; F21S 8/04; F21V 15/015; F21V 23/06; F21V 29/70;
(Continued)

(56) References Cited

U.S. PATENT DOCUMENTS 7,048,410 B2 5/2006 Kutler
8,523,394 B2 * 9/2013 Simon ..... F21V 25/04 362/249.05
(Continued)

FOREIGN PATENT DOCUMENTS

CN 102384440 A 3/2012
JP 2007-128843 5/2007
(Continued)

OTHER PUBLICATIONS

Foreign Communication From a Related Counterpart Application, European Application No. 14854810.0-1757, Extended European Search Report dated Jan. 19, 2017, 9 pages.
International Search Report dated Dec. 21, 2014 in connection with International Patent Application No. PCT/KR2014/009376, 3 pages.
Written Opinion of the International Searching Authority dated Dec. 21, 2014 in connection wtih International Patent Application No. PCT/KR2014/009376, 3 pages.

*Primary Examiner* — Ali Alavi

(57) ABSTRACT

A lighting device includes a body portion on which a light source is mounted; a terminal unit, provided at each of both ends of the body portion, receiving power for driving the light source; and a sealing unit movably disposed between the body portion and the terminal unit so as to prevent a gap between the body portion and the terminal unit.

10 Claims, 4 Drawing Sheets

(51) Int. Cl.

| | |
|---|---|
| ***F21V 15/015*** | (2006.01) |
| ***F21V 23/06*** | (2006.01) |
| ***F21K 9/275*** | (2016.01) |
| *F21Y 103/10* | (2016.01) |
| *F21Y 115/10* | (2016.01) |
| *F21V 29/70* | (2015.01) |
| *F21V 29/89* | (2015.01) |
| *F21S 8/04* | (2006.01) |
| *F21V 7/00* | (2006.01) |
| *F21V 3/06* | (2018.01) |

(52) U.S. Cl.
CPC . *F21S 8/04* (2013.01); *F21V 3/06* (2018.02); *F21V 7/005* (2013.01); *F21V 29/70* (2015.01); *F21V 29/89* (2015.01); *F21Y 2103/10* (2016.08); *F21Y 2115/10* (2016.08)

(58) Field of Classification Search
CPC ..... F21V 29/89; F21V 31/00; F21V 7/005; F21Y 2103/10; F21Y 2115/10
See application file for complete search history.

(56) References Cited

U.S. PATENT DOCUMENTS

| | | | | |
|---|---|---|---|---|
| 2009/0116218 | A1* | 5/2009 | Liu | F21V 14/00 362/84 |
| 2010/0304079 | A1 | 12/2010 | Yang et al. | |
| 2013/0049598 | A1* | 2/2013 | Nagashima | H05B 33/0803 315/113 |
| 2017/0054315 | A1* | 2/2017 | Chien | F21S 8/035 |

FOREIGN PATENT DOCUMENTS

| | | | |
|---|---|---|---|
| JP | 2010251277 | A | 11/2010 |
| JP | 2012043558 | A | 3/2012 |
| KR | 20-2010-0008100 | | 8/2010 |
| KR | 20-2010-0009900 | | 10/2010 |
| WO | 2011021457 | A1 | 2/2011 |
| WO | WO 2012/131522 | A1 | 10/2012 |

* cited by examiner

[Fig. 1]
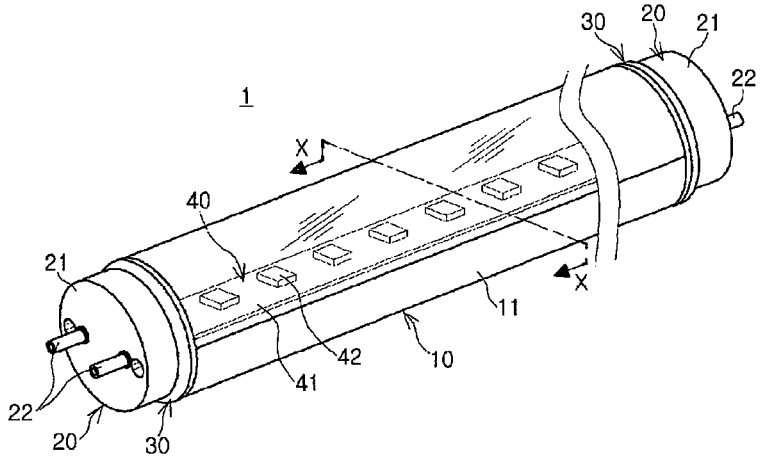
[Fig. 2]
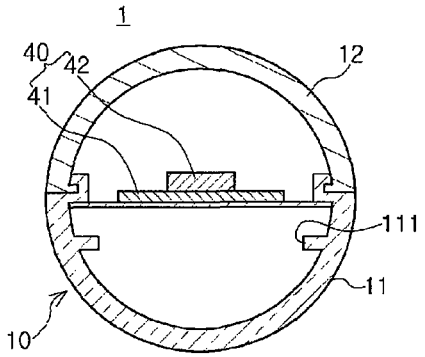
[Fig. 3]
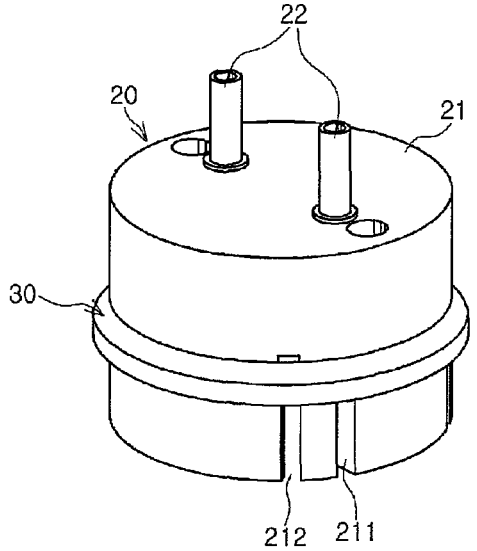

[Fig. 4a]
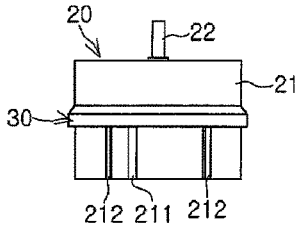
[Fig. 4b]
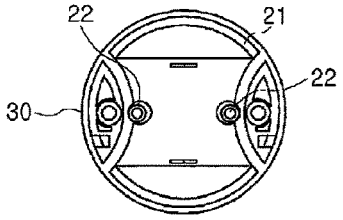
[Fig. 5]
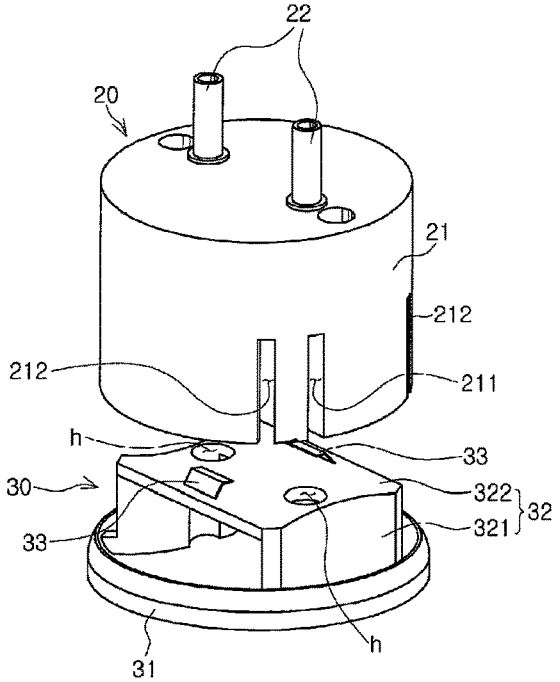
[Fig. 6a]
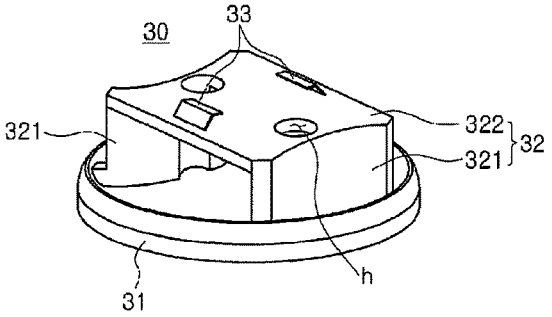

[Fig. 6b]
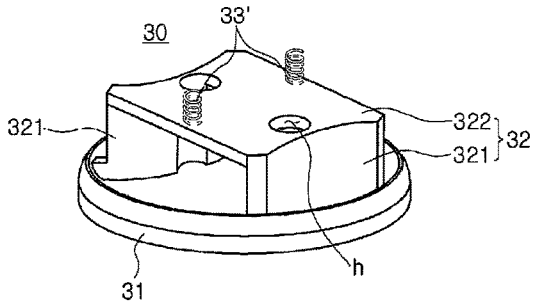
[Fig. 7a]
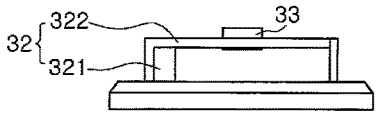
[Fig. 7b]
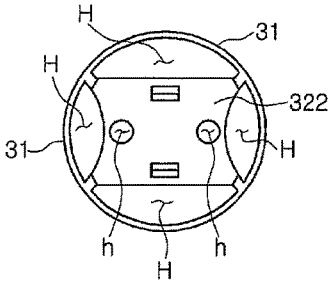
[Fig. 8a]
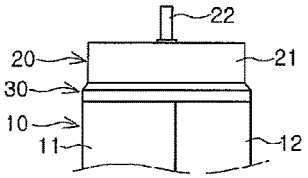
[Fig. 8b]
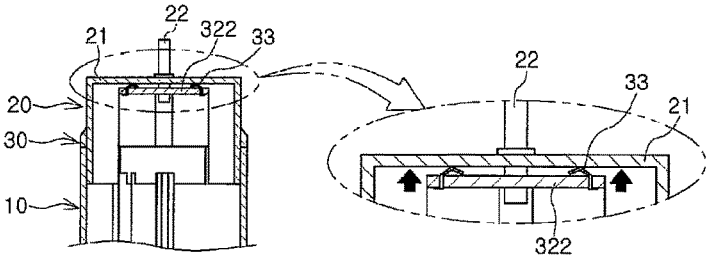
[Fig. 9a]
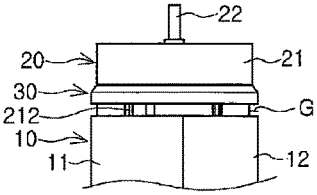

[Fig. 9b]
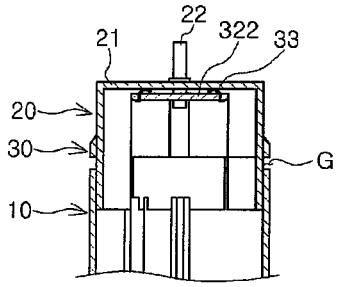
[Fig. 10a]
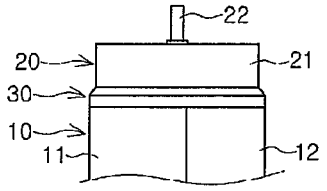
[Fig. 10b]
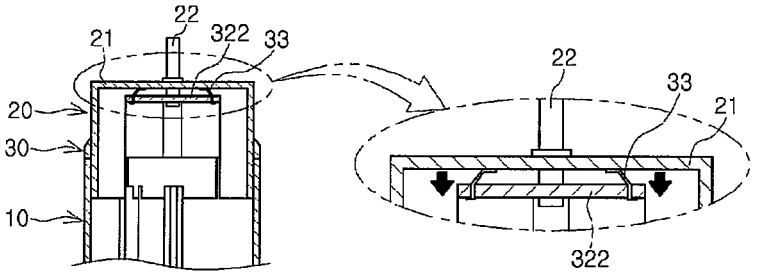
[Fig. 11]
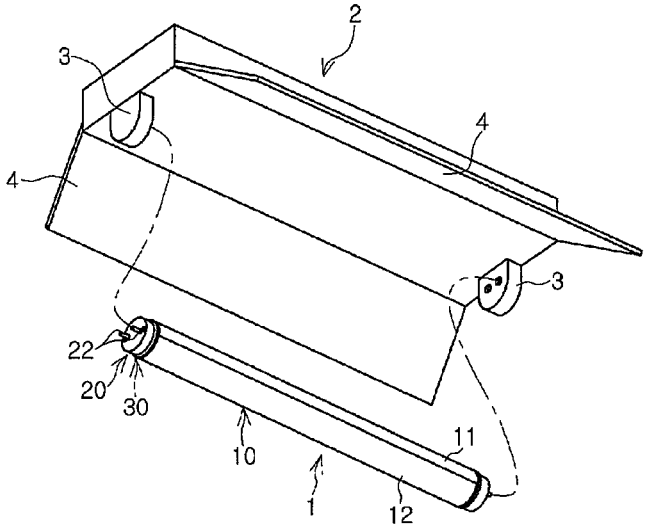

LIGHTING DEVICE

CROSS-REFERENCE TO RELATED APPLICATION(S) AND CLAIM OF PRIORITY

This application is a continuation of International Application No. PCT/KR2014/009376 filed on Oct. 6, 2014, which claims priority to Korean Patent Application No. 10-2013-0123796 filed on Oct. 17, 2013, each of which are hereby incorporated by reference into the present disclosure as if fully set forth herein.

TECHNICAL FIELD

One or more embodiments of the present invention relate to a lighting device.

BACKGROUND

Fluorescent lamp type light-emitting diode (LED) lamps consume less power and longer lifespan, and thus are replacing widely used fluorescent lamps. The fluorescent lamp type LED lamps have the same external shape as the fluorescent lamps so as to be compatible with the fluorescent lamps.

However, when an LED lamp is repeatedly heated and cooled due to the heat generated from an LED, a body portion may be modified due to contraction and expansion, thereby creating a gap in a connecting portion between a cap and the body portion. In the long term, the gap may function as a path that allows external impurities to flow into the lamp, thereby causing malfunction or damages. Also, a dark space may be created due to inflow of impurities.

SUMMARY

Therefore, a method of preventing a gap from being generated due to a structure modification caused by temperature change in a fluorescent type lamp that uses an LED as a light source is required in the technical field to which the embodiments of the present invention pertains.

However, the goal of the present invention is not limited thereto, but also includes technical goals or effects that are not evidently described but may be derived from the solutions for achieving the technical goals and the embodiments described below.

According to one or more embodiments of the present invention, a lighting device includes a body portion on which a light source is mounted; a terminal unit, provided at each of both ends of the body portion, receiving power for driving the light source; and a sealing unit that is movably disposed between the body portion and the terminal unit so as to prevent a gap between the body portion and the terminal unit.

The sealing unit may include a frame that is hollow and coupled to the terminal unit such that the frame moves along an external surface of the terminal unit; and a base that is partially connected to an inner surface of the frame and protrudes toward an inner bottom surface of the terminal unit.

The frame may have a ring shape corresponding to a cross-section of the terminal unit, the inner surface of the frame surface may contact the external surface of the terminal unit, and a cross-section of the frame that is perpendicular to the inner surface of the frame surface may contact an end surface of the body portion.

An external surface of the frame may be inclined and curved from one surface to the other surface.

The base may include at least one pair of side walls extending from the inner surface of the frame, and a plane connecting the at least one pair of side walls. The plane may include an elastomer that creates elasticity and contacts the inner bottom surface of the terminal unit.

The elastomer may include a leaf spring and a coil spring.

A hole, through which the terminal unit is partially inserted, may be formed between the at least one pair of side walls and the frame.

The sealing unit may be formed of one selected from polycarbonate (PC), polybutylene terephthalate (PBT), silicone, and a polymer thereof.

The terminal unit may include a cap that includes an external surface and an inner bottom surface defined by the external surface, and an electrode pin that penetrates through the inner bottom surface of the cap and extends to an outside.

The external surface of the cap may be coupled to the sealing unit, and a plurality of guiding holes that guide movement of the sealing unit may be formed in the external surface of the cap.

A plurality of coupling holes, which are coupled to the body portion when the terminal unit is inserted into either open end of the body portion, may be formed at the external surface of the cap.

The body portion may include a heat sink having the light source provided at a side thereof, and a cover that is coupled to the heat sink so as to cover the light source.

The light source may include a substrate, and a plurality of light-emitting devices arrayed on the substrate.

According to one or more embodiments of the present invention, a lighting device includes a body portion on which a light source is mounted; a terminal unit including a cap inserted in each of both open ends of the body portion, and an electrode pin that protrudes from the cap and receives power for driving the light source; and a sealing unit that is movably disposed between the body portion and the terminal unit, moves along an external surface of the terminal unit by being fastened to an external surface of the cap, and prevents a gap between the body portion and the terminal unit.

The sealing unit may include a frame that has a ring shape and is fastened to an external surface of the cap, and a base that is partially connected to an inner surface of the frame and includes an elastomer that creates elasticity when the cap is closely attached to an inner bottom surface of the terminal unit.

One or more embodiments of the present invention include a lighting device in which a gap is not created due to a structure modification caused by temperature change.

Additional aspects will be set forth in part in the description which follows and, in part, will be apparent from the description, or may be learned by practice of the presented embodiments.

BRIEF DESCRIPTION OF THE DRAWINGS

These and/or other aspects will become apparent and more readily appreciated from the following description of the embodiments, taken in conjunction with the accompanying drawings in which:

FIG. 1 is a perspective view schematically illustrating a light device, according to an embodiment of the present invention;

FIG. 2 is a schematic sectional view of the lighting device cut along the line X-X of FIG. 1;

FIG. 3 is a perspective view schematically illustrating a terminal unit coupled to a sealing unit in the lighting device of FIG. 1;

FIGS. 4*a* and 4*b* respectively are a side view and a bottom plan view schematically illustrating the terminal unit of FIG. 3;

FIG. 5 is an exploded perspective view schematically illustrating the terminal unit and the sealing unit of FIG. 3;

FIGS. 6*a* and 6*b* are perspective views schematically illustrating the sealing unit of FIG. 5;

FIGS. 7*a* and 7*b* respectively are a side view and a plan view schematically illustrating the sealing unit of FIG. 6;

FIGS. 8*a* and 8*b* respectively are a side view and a cross-sectional view schematically illustrating a state where a terminal unit, having a sealing unit fastened thereto, is inserted into and coupled to an open end of a body portion;

FIGS. 9*a* and 9*b* respectively are a side view and a cross-sectional view schematically illustrating a state where a gap is created due to modification of a body portion;

FIGS. 10*a* and 10*b* respectively are a side view and a cross-sectional view schematically illustrating a state where a gap is eliminated by using a sealing unit; and FIG. 11 is a perspective view schematically illustrating a fixing structure on which a lighting device is mounted.

DETAILED DESCRIPTION

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. Expressions such as "at least one of," when preceding a list of elements, modify the entire list of elements and do not modify the individual elements of the list.

A lighting device 1 according to an embodiment of the present invention will be described with reference to FIGS. 1 and 2. FIG. 1 is a perspective view schematically illustrating the light device 1, according to an embodiment of the present invention. FIG. 2 is a schematic sectional view of the lighting device 1 cut along the lines X-X of FIG. 1.

Referring to FIGS. 1 and 2, the lighting device 1 according to an embodiment of the present invention may include a body portion 10, a terminal unit 20, and a sealing unit 30.

The body portion 10 functions as a supporting member for mounting and fixing a light source 40. Also, the body portion 10 may define an overall shape of the lighting device 1.

As illustrated in FIGS. 1 and 2, the body portion 10 may include a heat sink 11 having the light source 40 provided at a side thereof, and a cover 12 that is coupled to the heat sink 11 so as to cover the light source 40.

The heat sink 11 may be shaped like a long pole that is longitudinally elongated. The heat sink 11 may be formed of a material having excellent thermal conductivity, such as aluminum (Al), so as to easily radiate heat generated by the light source 40. However, the material is not limited thereto.

The cover 12 may be detachably attached to the heat sink 11. The cover 12 may be formed of a light-transmitting material so that light generated by the light source 40 may be externally irradiated. The light-transmitting material of the cover 12 may be glass, or transparent or non-transparent resin, but is not limited thereto.

The cover 12 may not only cover the light source 40 and thus protect the light source 40 from external environment, but also curve light generated by the light source 40 and thus irradiate light to a wide region. Also, a light diffusing material may be included in the cover 12 to diffuse light. The light diffusing material may include, for example, titanium dioxide (TiO2).

The body portion 10, which is configured of the heat sink 11 and the cover 12 coupled thereto, may have a cylindrical tube shape corresponding to a fluorescent lamp so that the lighting device 1 may replace the fluorescent lamp. Alternatively, the body portion 10 may have other various shapes.

The light source 40 may be mounted and fixed on a side of the heat sink 11, and may be electrically connected to the heat sink 11. The light source 40 may include a substrate 41 and a plurality of light-emitting devices 42 mounted on the substrate 41.

The substrate 41 may be a general FR4 printed circuit board (PCB); be formed of an organic resin material including epoxy, triazine, silicone, polyimide, etc., a ceramic material such as silicon nitride, AlN, Al2O3, etc., or a metal and a metallic compound; and include a metal core PCB (MCPCB), a metal copper-clad laminate (MCCL), and the like.

Each of the plurality of light-emitting device 42 may be any photoelectric device that generates light having a predetermined wavelength by an external power supply, and may include, in particular, a semiconductor light-emitting diode (LED) generated by epitaxially growing a semiconductor layer on a growth substrate. Each light-emitting device 42 may emit blue, green, red, or white light depending on a material included therein.

For example, each light-emitting device 42 may have, but is not limited to, a structure formed by stacking an n-type semiconductor layer, a p-type semiconductor layer, and an active layer disposed between the n-type and p-type semiconductor layers. Also, the active layer may be formed of a nitride semiconductor that includes $In_xAl_yGa_{(1-x-y)}N$ (0=x=1, 0=y=1, 0=x+y=1) having a single or multiple quantum well structure.

The plurality of light-emitting devices 42 may be LED chips having various structures, or various types of LED packages that include such LED chips.

The substrate 41 may be configured as a plate having a long bar shape that is elongated in a longitudinal direction, like the heat sink 11. A structure and a shape of the substrate 41 may be modified in various ways with respect to a structure of a lighting device according to an embodiment of the present invention.

The plurality of light-emitting devices 42 may be arrayed at predetermined intervals in a longitudinal direction of the substrate 41. According to an embodiment of the present invention, the plurality of light-emitting devices 42 are arrayed in a single line. However, the embodiments of the present invention are not limited thereto, and the plurality of light-emitting devices 42 may be arrayed in a plurality of lines.

Although not illustrated, electronic devices, such as a trance, a sensor, Bluetooth, etc., may be additionally included in the heat sink 11.

The terminal unit 20 is provided in each of both ends of the body portion 10, and receives power from an external power source for driving the light source 40. FIGS. 3 to 5 schematically illustrate a structure of the terminal unit 20.

The terminal unit 20 may include a cap 21, which includes an external surface having a sectional shape corresponding to a sectional shape of the body portion 10 and an inner bottom surface defined by the external surface, and a pair of electrode pins 22 that penetrates through the inner bottom surface of the cap 21 and extends to the outside.

The cap 21 is coupled to either open end of the body portion 10 by being inserted therein, and thus covers the either open end. In other words, the cap 21 is an inner type and may function as a plug. Accordingly, an end of the cap 21 that is inserted in the body portion 10 is exposed. Also, a diameter of the external surface of the cap 21 may be equal to or less than a diameter of an inner surface of the body portion 10, so that the terminal unit 20 may be inserted in the body portion 10.

A plurality of coupling holes 211, which are coupled to the body portion 10 when the terminal unit 20 is inserted into the either open end of the body portion 10, may be formed at the external surface of the cap 21. In order to engage each coupling hole 211 are engaged with a projection 111, each coupling hole 211 may be formed with respect to a location of the projection 111 that is formed in the heat sink 11 of the body portion 10. Each coupling holes 211 may extend in a predetermined length from an open end of the cap 21 to the inner bottom surface of the cap 21. Therefore, a degree of insertion of the cap 21 into the body portion 10 may be adjusted depending on a depth of the plurality of coupling holes 211.

According to an embodiment of the present invention, the plurality of coupling holes 211 are prepared as a pair of coupling holes facing each other at the external surface of the cap 21. However, the plurality of coupling holes 211 are not limited thereto. Locations and the number of the plurality of coupling holes 211 may be modified in various ways with respect to the body portion 10.

As illustrated in FIGS. 3 and 5, other than the plurality of coupling holes 211, a plurality of guiding holes 212 may be additionally formed at the external surface of the cap 21. The plurality of guiding holes 212 will be described below.

The sealing unit 30 is movably provided between the body portion 10 and the terminal unit 20 so as to prevent a gap from being created between the body portion 10 and the terminal unit 20. FIGS. 5 to 7 schematically illustrate the sealing unit 30.

Specifically, the sealing unit 30 may include a frame 31 that is hollow, fastened along a circumference of the terminal unit 20, and assembled such that the frame 31 may move along the external surface of the terminal unit 20, and a base 32 that is partially connected to an inner surface of the frame 31 and protrudes toward the inner bottom surface of the terminal unit 20.

As illustrated in FIGS. 6*a*, 6*b*, 7*a*, and 7*b*, the frame 31 may be formed in a ring shape corresponding to a sectional shape of the cap 21 of the terminal unit 20 so that the frame 31 may be fastened and coupled to the external surface of the terminal unit 20.

An inner surface of the frame 31 having a ring shape may surface contact the external surface of the cap 21 of the terminal unit 20, and a cross-section of the frame perpendicular to the inner surface may surface contact an end surface of the body portion 10. Also, an external surface of the frame 31 may be inclined and curved from one surface to the other surface. The curved external surface provides a gradual curve so as to prevent a step between the body portion 10 and the terminal unit 20 and thus realize smooth connection between the body portion 10 and the terminal unit 20. Accordingly, external completeness may be increased.

The base 32 includes at least one pair of side walls 321 extending from the inner surface of the frame 31, and a plane 322 connecting the at least one pair of side walls 321. The base 32 may be integrally formed with the frame 31.

The at least one pair of side walls 321 is disposed to face each other, and have a concave shape with curves. Therefore, a hole H, in which the cap 21 of the terminal unit 20 may be partially inserted, may be formed between the at least one pair of side walls 321 and the frame 31.

That is, when coupling the sealing unit 30 with the terminal unit 20, the inner surface of the frame 31 is fastened to the external surface of the cap 21 of the terminal unit 20. Here, portions of the at least one pair of side walls 321 that are connected to the inner surface of the frame 31 may be inserted into the plurality of guiding holes 212 that are formed in the external surface of the cap 21. Also, the cap 21 may be inserted into and penetrate through the hole H. Accordingly, the sealing unit 30 may be guided to move along the guiding holes 212 in the external surface of the cap 21.

The plane 322 may include an elastomer 33 that creates elasticity and contacts the inner bottom surface of the terminal unit 20. The elastomer 33 may include a leaf spring as illustrated in FIG. 6*a*. Also, an elastomer 33' may include a coil spring as illustrated in FIG. 6*b*. Other elastic elements may all be included.

Through holes h, through which the pair of electrode pins 22 that are partially protruding from the inner bottom surface of the terminal unit 20 may be inserted, may be formed in the plane 322, correspondingly to respective locations of the electrode pins 22. Also, a wire connected to the electrode pins 22 may extend to an inner part of the body portion 10 via the through hole h and thus be connected to the light source 40.

For example, the sealing unit 30 may be formed of one selected from polycarbonate (PC), polybutylene terephthalate (PBT), silicon, and a polymer thereof.

*71Operation mechanism of the sealing unit 30 in the lighting device 1 according to an embodiment of the present invention will be described with reference to FIGS. 8 to 10.

First, FIGS. 8*a* and 8*b* schematically illustrate a state where the terminal unit 20, having the sealing unit 30 fastened thereto, is inserted into and coupled to an open end of the body portion 10. Accordingly, when the terminal unit 20 and the body portion 10 are firmly coupled to each other, a completely sealed state, where a gap is not created between the terminal unit 20 and the body portion 10, is realized. In this case, the sealing unit 30 firmly attached to the terminal unit 20 by the body portion 10, and thus, the elastomer 33 maintains elasticity and is pressed by the inner bottom surface of the terminal unit 20.

Next, FIGS. 9*a* and 9*b* schematically illustrate a state where a gap G is created due to modification of the body portion 10. In other words, when the body portion 10 is modified due to contraction and expansion due to heating or cooling caused by repeated operation of the lighting device 1 or temperature changes of an external environment, the gap G may be created between the body portion 10 and the terminal unit 20.

FIGS. 10*a* and 10*b* schematically illustrate where a gap is eliminated by using the sealing unit 30. When a gap is created as in FIGS. 9*a* and 9*b*, a force generated by the body portion 10, which fixes the sealing unit 30 to the terminal unit 20, disappears. That is, the force that maintains a state where the elastomer 33 pressed by the inner bottom surface of the terminal unit 20 disappears. Therefore, the sealing unit 30 recovers to an original location due to a restoring force corresponding to an elastic force of the elastomer 33. That is, the gap is eliminated by moving the sealing unit 30 toward the body portion 10.

Accordingly, the sealing unit 30 that has elasticity may prevent a gap from being created between the terminal unit 20 and the body portion 10. Thus, it is possible to prevent external impurities from flowing into the body portion 10 and causing malfunctioning of the lighting device 1 and dark spaces.

FIG. 11 schematically illustrates a fixing structure 2 on which the lighting device 1 is mounted.

As illustrated in FIG. 11, when the lighting device 1 is mounted on the fixing structure 2, the terminal unit 20 is physically and electrically coupled to sockets 3 provided at both ends of the fixing structure 2 by using the electrode pins 22. Also, the terminal unit 20 may supply power to the lighting device 1.

The fixing structure 2 may be fixed to, for example, a ceiling in a building. Since the fixing structure 2 includes a power supply unit (PSU), the fixing structure 2 may steadily supply driving power. Also, the fixing structure 2 may include a reflecting shade 4.

The above-described lighting device using an LED may be divided into an indoor type and an outdoor type according to its use. Indoor LED lighting devices mainly are retrofit lamps, and may include lamps, fluorescent lamps (LED-tube), and flat plate lighting devices. Outdoor LED lighting devices may include streetlamps, security lamps, floodlight lamps, landscape lamps, traffic lights, etc.

Also, an LED lighting device may be applied to robots or various machines as a light source. In particular, an LED lighting device using a special wavelength band may accelerate plant growth, or function as an emotional lighting for easing a person's feelings or treatment of diseases.

It should be understood that the exemplary embodiments described herein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims.

The present invention relates to a lighting device.

What is claimed is:

1. A lighting device comprising:

a body portion on which a light source is mounted;

a terminal unit, provided at each of both ends of the body portion, configured to receive power for driving the light source; and a sealing unit that is movably disposed between the body portion and the terminal unit so as to prevent a gap between the body portion and the terminal unit.

2. The lighting device of claim 1, wherein the sealing unit comprises:

a frame that is hollow and coupled to the terminal unit such that the frame moves along an external surface of the terminal unit; and a base that is partially connected to an inner surface of the frame and protrudes toward an inner bottom surface of the terminal unit.

3. The lighting device of claim 2, wherein the frame has a ring shape corresponding to a cross-section of the terminal unit, the inner surface of the frame surface contacts the external surface of the terminal unit, and a cross-section of the frame that is perpendicular to the inner surface of the frame surface contacts an end surface of the body portion.

4. The lighting device of claim 2, wherein the base comprises at least one pair of side walls extending from the inner surface of the frame, and a plane connecting the at least one pair of side walls, and wherein the plane comprises an elastomer that creates elasticity and contacts the inner bottom surface of the terminal unit.

5. The lighting device of claim 4, wherein the elastomer comprises a leaf spring and a coil spring.

6. The lighting device of claim 4, wherein a hole, through which the terminal unit is partially inserted, is formed between the at least one pair of side walls and the frame.

7. The lighting device of claim 1, wherein the terminal unit comprises a cap that comprises an external surface and an inner bottom surface defined by the external surface, and an electrode pin that penetrates through the inner bottom surface of the cap and extends to an outside.

8. The lighting device of claim 7, wherein the external surface of the cap is coupled to the sealing unit, and a plurality of guiding holes that guide movement of the sealing unit are formed in the external surface of the cap.

9. The lighting device of claim 8, wherein a plurality of coupling holes, which are coupled to the body portion when the terminal unit is inserted into either open end of the body portion, are formed at the external surface of the cap.

10. A lighting device comprising:

a body portion on which a light source is mounted;

a terminal unit comprising a cap inserted in each of both open ends of the body portion, and an electrode pin that protrudes from the cap and is configured to receive power for driving the light source; and a sealing unit that is movably disposed between the body portion and the terminal unit, and configured to:

move along an external surface of the terminal unit by being fastened to an external surface of the cap, and prevent a gap between the body portion and the terminal unit.

* * * * *